United States Patent [19]

Rudolph

[11] 4,364,469

[45] Dec. 21, 1982

[54] BOTTOM SUSPENSION ARRANGEMENT FOR A LIQUID SCREW CONVEYOR ASSEMBLY

[75] Inventor: Siegfried Rudolph, Hanover, Fed. Rep. of Germany

[73] Assignee: Schreiber-Klaranlagen Dr. Ing. Aug. Schreiber GmbH & Co. KG, Langenhagen, Fed. Rep. of Germany

[21] Appl. No.: 235,628

[22] Filed: Feb. 18, 1981

[30] Foreign Application Priority Data

Feb. 18, 1980 [DE] Fed. Rep. of Germany ..... 3006057

[51] Int. Cl.[3] ..... B65G 65/34; B65G 33/32

[52] U.S. Cl. ..... 198/616; 198/672

[58] Field of Search ..... 198/672, 657, 616, 558

[56] References Cited

U.S. PATENT DOCUMENTS

| | | | |
|---|---|---|---|
| 1,607,713 | 11/1926 | Wickey | 198/657 |
| 1,729,211 | 9/1929 | Erisman | 198/672 |
| 3,796,508 | 3/1974 | Rowley | 198/657 |

*Primary Examiner*—John J. Love

*Assistant Examiner*—Brian Bond

*Attorney, Agent, or Firm*—Watson, Cole, Grindle & Watson

[57] ABSTRACT

A bottom suspension arrangement is provided for a screw conveyor assembly used in the pumping of waste water and the like. The assembly includes a stationary cylindrical jacket having an open bottom end, a screw conveyor mounted within the jacket for rotation about a central axis, and an anti-friction bottom bearing on the screw conveyor extending outwardly of the bottom open end of the jacket. The bottom suspension arrangement is attached to the screw conveyor assembly at its bottom end, and comprises a rigid, substantially L-shaped lever having one leg mounted at its terminal end on the bearing and having its other leg spaced from and extending along the upper side of the jacket. A suspension point is located at the terminal end of this other leg for the attachment of a suspension device, and the one leg overlaps radially with the open bottom end of the jacket. Brace plates interconnect the lever and the jacket and are mounted along a portion of the inner periphery of the jacket at the open bottom end thereof.

3 Claims, 6 Drawing Figures

L1
L2
L3
F0
F1
F1

L1
L2
L3
F0
F1
F1

BOTTOM SUSPENSION ARRANGEMENT FOR A LIQUID SCREW CONVEYOR ASSEMBLY

BACKGROUND OF THE INVENTION

This invention relates generally to a bottom suspension arrangement for a screw conveyer assembly, especially for the pumping of waste water, the assembly comprising a stationary cylindrical jacket having an open bottom end, and a screw conveyer mounted within the jacket for rotation about a central axis. A bottom, anti-friction bearing on the screw conveyor extends outwardly of the open bottom end of the jacket, and the suspension arrangement is connected to both the bearing and to a portion of the jacket.

In prior art screw conveyor assemblies of this type, the point of suspension for the bottom end of the jacket lies either between or outwardly of the radial load components acting at points of attachment between the suspension arrangement and the assembly. Considerable bending moments are thus exerted on the bottom end of the jacket. Experiments have shown that these bending moments, which subject the jacket to considerable pressure and cause it to buckle, can be so great that the jacket becomes deformed and assumes an oval shape causing the spiral conveyor housed within the jacket to strike or rub against the inner wall thereof. This results in premature wear of the screw conveyor assembly and a decrease in the efficiency of the pump, especially as regards the return losses of the water being pumped. And, increasing the diameter of the jacket does not solve the problem since the greater the diameter the more the disadvantageous effect with respect to the stability of the shape of the jacket.

SUMMARY OF THE INVENTION

It is, therefore, an object of the present invention to improve upon known bottom suspension arrangements for screw conveyor assemblies wherein the bottom end of the jacket is suspended without interfering with the entry of water into its open bottom end and thereby the screw conveyor, and at the same time permits only such low bending moments to occur in the jacket as can be accomodated by its wall strength, thereby requiring a minimum gauge material for the jacket. Moreover, the present suspension substantially avoids the likelihood of the jacket being deformed into an oval shape.

The bottom suspension of the screw conveyor assembly according to the invention makes it possible to transfer the suspension point from outwardly of the bottom of the jacket (as in the prior art) to a plane within the cross-section of the cylindrical jacket of the screw conveyor. This is accomplished by the provision of a rigid, substantially L-shaped lever having one of its legs supporting the bottom bearing, and the lever being mounted on the bottom end of the jacket without interfering with the bottom open end which defines the water inlet for the waste water to be pumped. The other leg of the lever has a suspension point located at the terminal end thereof, this other leg being spaced from and extending along the side of the jacket. Such an arrangement effects a transfer of the suspension point, compared to prior art bottom suspensions, to an area inwardly of the bottom open end of the jacket. Thus, any deformation or bending of the jacket into an oval shape is substantially avoided by the present bottom suspension arrangement, and any misalignment of the screw conveyor relative to its surrounding jacket is likewise substantially avoided.

With the present bottom suspension arrangement, bending moments about the suspension point are established by the transverse load components of the weight of the water being pumped, the weight of the jacket and the weight of the screw conveyor, and these bending moments are substantially cancelled out by a bending moment about the suspension point established by the axial load components of the water weight, the jacket weight and the screw conveyor weight. Any residual bending of moments remaining, as established by other loads, are transferred from the mounting of the lever to the jacket and may cause the jacket to buckle, but only slightly without having any deleterious effect.

Other objects, advantages and novel features of the invention will become more apparent from the following detailed description of the invention when taken in conjunction with the accompanying drawing.

DETAILED DESCRIPTION OF THE INVENTION

Figure 1:
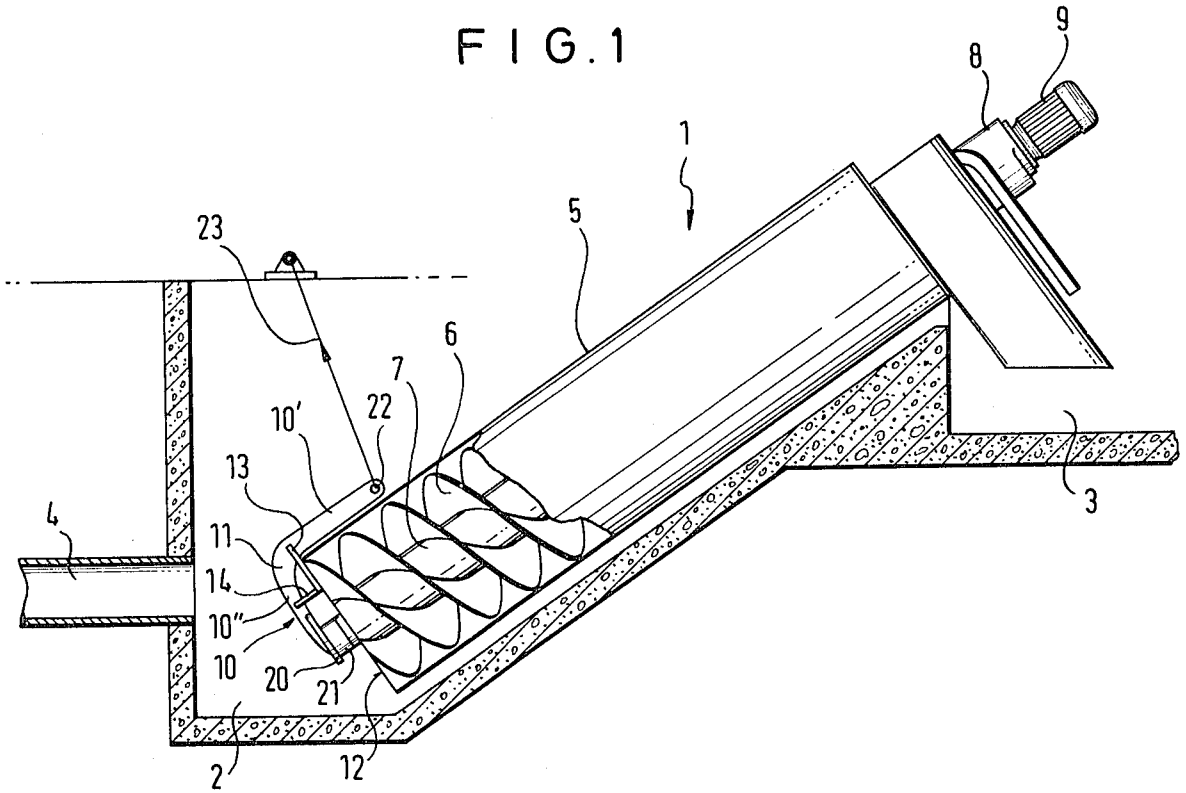
FIG. 1 is a side elevational view of the bottom suspension arrangement according to the invention, shown to a screw conveyor assembly, partly broken away, disposed in a tank from which the waste water is to be pumped.

Turning now to the drawing wherein like reference characters refer to like and corresponding parts throughout the several views, a screw conveyor assembly is generally designated 1 in FIG. 1 and is shown mounted in place at its upper end, in any normal manner, within the bottom of a tank 2 for the pumping of a liquid, especially waste water, from the bottom of the tank to an upper passage 3. An inlet conduit 4 is located in the side wall of the tank for the waste water to be pumped, and passage 3 represents the outlet from the system.

The screw conveyor assembly comprises a stationary cylindrical jacket 5 surrounding an endless spiral screw conveyor 6, supported on a central elongated tube 7, which is rotated by a drive motor 9 provided with a reduction gearing 8. The entire screw conveyor assembly is disposed at an angle, as shown in FIG. 1, and tube 7 is mounted coaxially within jacket 5 at its upper end via an upper anti-friction bearing (not shown).

Figure 2:
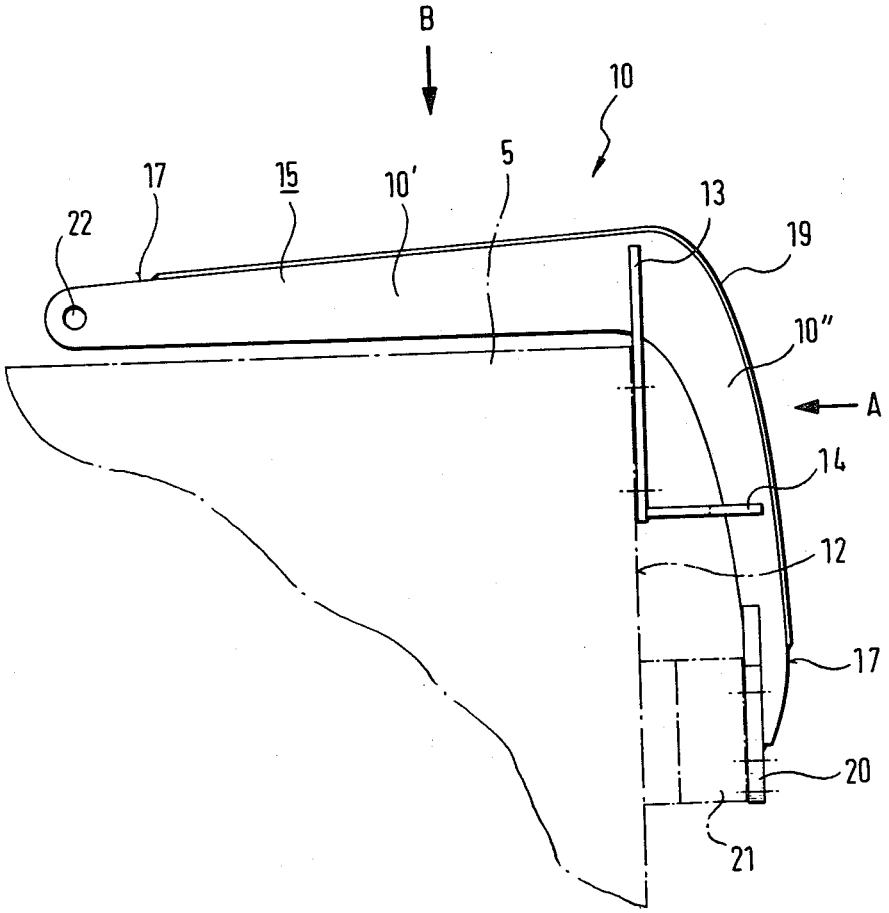
FIG. 2 is a side view, at an enlarged scale showing details of the bottom suspension arrangement.
Figure 3:
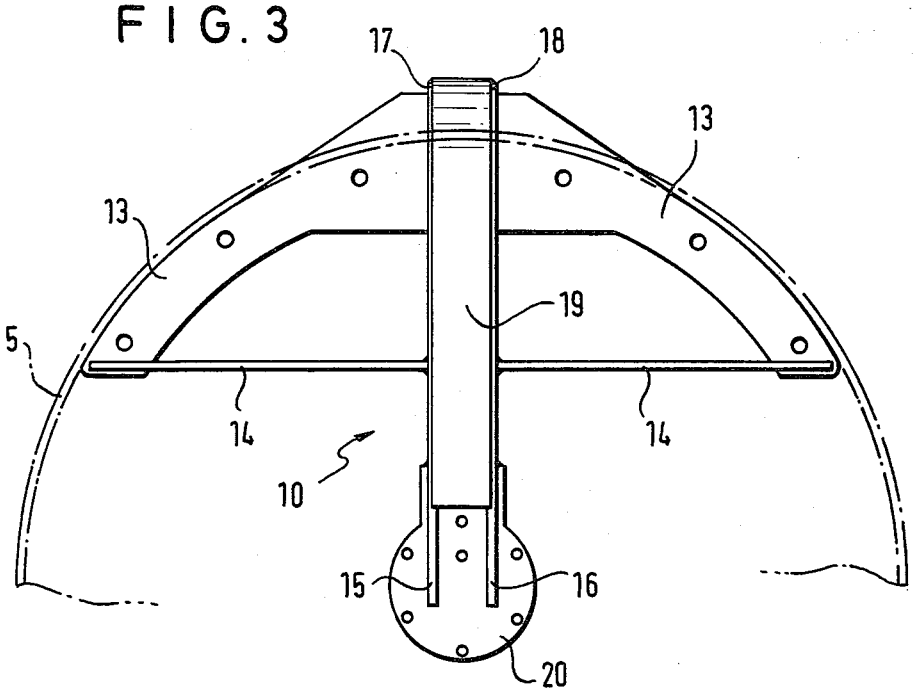
FIG. 3 is a view of the bottom suspension arrangement taken in the direction of arrow A of FIG. 2.
Figure 4:
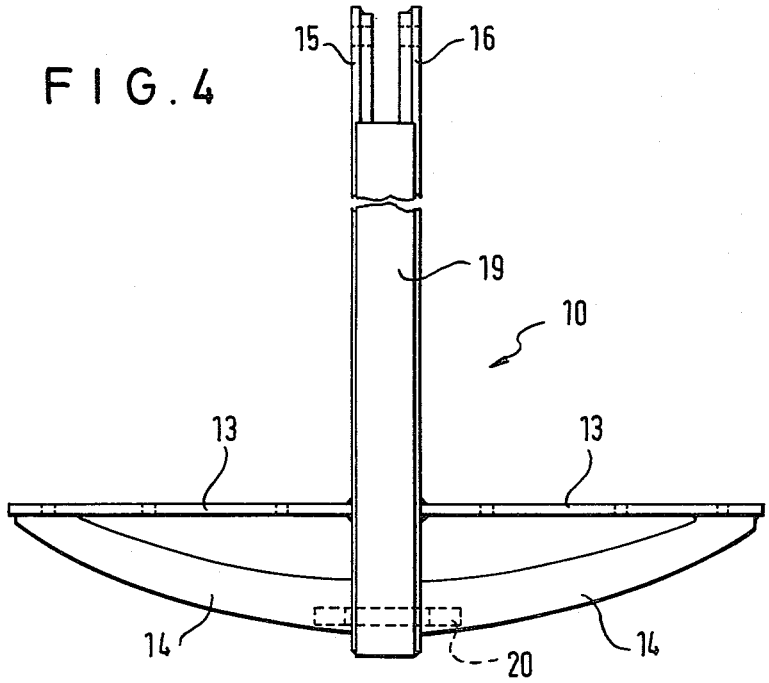
FIG. 4 is the view of the suspension arrangement taken in the direction of arrow B of FIG. 2.

The bottom suspension arrangement according to the invention is generally designated 10 and comprises a rigid, substantially L-shaped lever having one arm 10″ thereof overlapping radially with open bottom end 12 of the jacket, as more clearly shown in FIG. 2. The other leg 10′ of the lever is spaced slightly away from and extends along an upper side of the jacket. At a bend zone 11, the lever is secured to the open bottom end of the jacket by means of curved brace plates 13 which are mounted along a portion of the inner periphery of the jacket, as shown in FIG. 3. Axially extending and curved brace plates 14 interconnect leg 10'' of the lever with the terminal ends of plates 13 (see FIGS. 3 and 4).

In order to enhance the rigidity of the L-shaped lever, it is formed by a pair of spaced and parallel L-shaped lever sections 15 and 16 (FIG. 4) interconnected together along their outer edges by a strip 19 by a strip 19.

At the terminal end of leg 10'', a support plate 20 is attached and a bottom anti-friction bearing 21 is mounted thereto. This bearing extends outwardly of open bottom end 12 of the jacket and is affixed to tube 7.

The terminal end of leg 10' has axial bores 22, provided in lever sections 15 and 16, to thereby define a suspension point 22 for the attachment of a suspension device which is not illustrated but which is generally indicated by an arrow 23 in FIG. 1, which may comprise, for example, a tie rod extending from a support mount (unreferenced) affixed to the upper edge of the tank.

Figure 6:
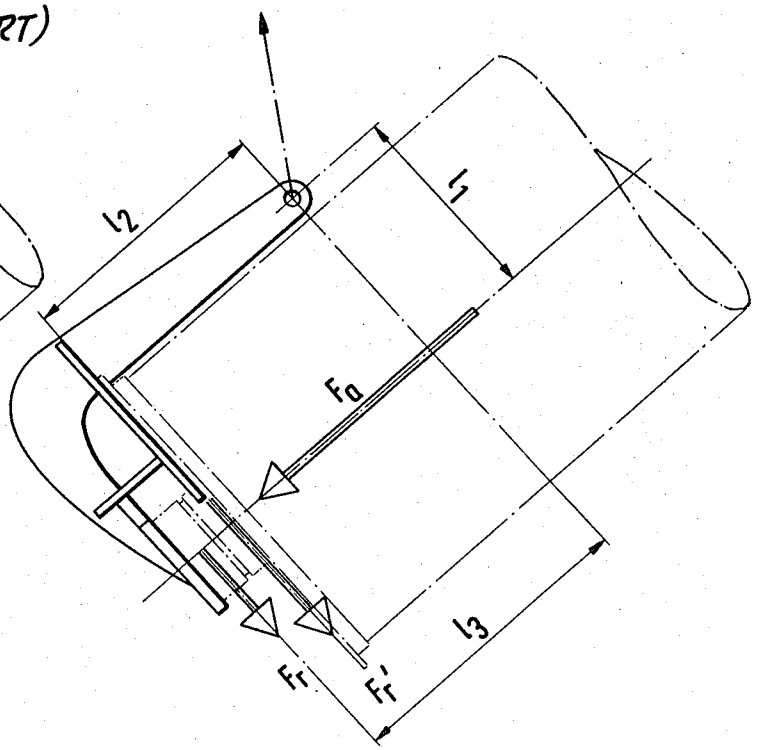
FIG. 6 is a side view of the bottom suspension arrangement of the invention for a screw conveyor assembly illustrating the acting transverse axial load components.

With the present bottom suspension arrangement, the bending moments, respectively established by the axial and transverse load components, acting at the bottom end the screw conveyor assembly around the suspension point, substantially cancel out one another. As shown in FIG. 6, leg 10' of the lever has a predetermined length 2 between brace plates 13 and suspension point 22, and the suspension point is spaced a predetermined transverse distance l1 from the central axis of the screw conveyor assembly. The attachment between leg 10'' and tube 7 of the screw conveyor, via bearing 21, defines a first point of attachment at which transverse load components act a force vector Fr, spaced a distance l3 from the suspension point, illustrates the quantum of these load components which pertain to the weight of the screw conveyor. The attachment between brackets 13 and the open bottom end of the jacket defines a second point of attachment at which other transverse load components act. A force vector Fv', spaced a distance l2 from the suspension point, illustrates the quantum of these other load components which pertain to the weight of jacket 7 and the weight of the water being pumped. The summation of the axial load components of the weight of water being pumped, the weight of the jacket and the weight of the screw conveyor, is represented by a force vector Fa spaced a distance l1 from the suspension point. Thus, the total bending moment about the suspension point can be represented as $Mk = Fa.l1 - Fr'.l2 - Fr.l3$. In other words, the bending moment of the axial load component about the suspension point is cancelled out by the bending moments about the suspension point established by the transverse load components. The present bottom suspension arrangement, therefore, substantially avoids distortion or bending of the jacket into an oval shape which has presented problems with prior art arrangements.

Figure 5:
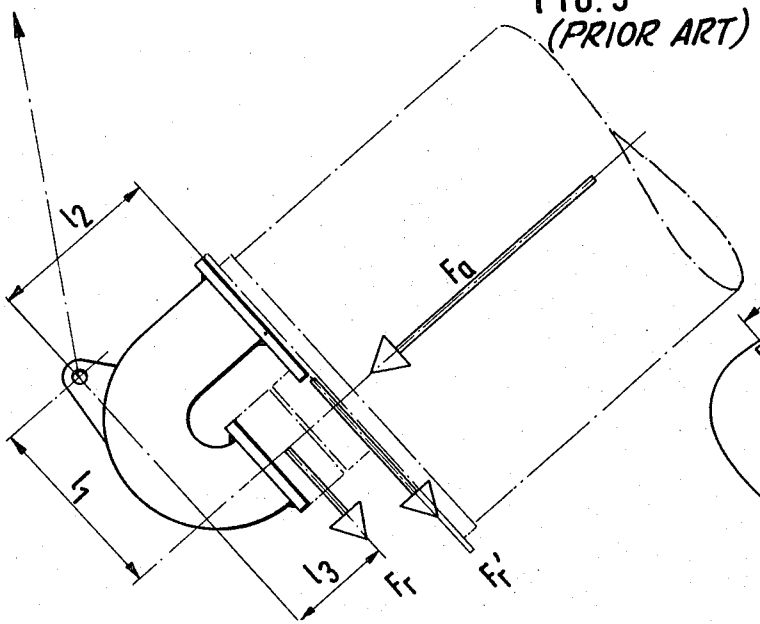
FIG.5 (PRIOR ART)
FIG. 5 is a side view of a prior art bottom suspension arrangement for a screw conveyor assembly illustrating the transverse and axial load components acting thereon.

One of such prior art arrangements is shown in FIG. 5 wherein of the suspension point is located outwardly of the open bottom end of the screw conveyor jacket (shown in phantom outline). The various force vectors and the distances thereof spaced from the suspension point are characterized in a manner similar to that described with reference to FIG. 6. Thus, the total bending moment about the suspension point in FIG. 5 is equal to a summation of the bending moments established by the axial and transverse load components as shown by the formula $Mk = Fa.l1 + Fr'.l2 + Fr.l3$. The advantages offered by the improved bottom suspension arrangement according to the invention, can therefore be seen by comparing the force vector diagrams of FIGS. 5 and 6, and the total bending moment formulas derived therefrom.

Obviously, many modifications of the variations of the present invention are made possible in the light of the above teachings. It is, therefore, to be understood that within the scope of the appended claims of the invention may be practiced otherwise than as specifically described.

What is claimed is:

1. A bottom suspension arrangement for a screw conveyor assembly, especially for the pumping of waste water, the assembly comprising a stationary cylindrical jacket having an open bottom end, a screw conveyor mounted within said jacket for rotation about a central axis thereof, said screw conveyor including a central elongated tube and a spiral blade supported thereon, an anti-friction bearing extending outwardly of said bottom end of said jacket and supporting a bottom end of said core, the arrangement being attached to the screw conveyor assembly for suspending the bottom end thereof within a tank containing waste water to be pumped, said arrangement comprising a rigid, substantially L-shaped lever having one leg mounted at its terminal end on said bearing so as to provide a first attachment point, the other leg of said lever being spaced from and extending along an upper side of said jacket, said other leg having a suspension point at its terminal end for the attachment of a suspension device, said one leg overlapping radially with said open bottom end, and brace plates interconnecting said lever and said jacket, said plates being mounted along a portion of the inner periphery of said jacket at said open bottom end so as to provide a second attachment point.

2. The assembly according to claim 1, wherein said other leg has a predetermined length between said brace plates and said suspension point, and said suspension point being spaced a predetermined transverse distance from said central axis, a first bending moment about said suspension point being established by the axial load components of the weight of water being pumped, the weight of said jacket and the weight of said screw conveyor, a second bending moment about said suspension point being established at said first attachment point by the transverse load components of said screw conveyor weight, and a third bending moment about said connecting point being established at said second attachment point by the transverse load components of said water weight and said jacket weight, said length and said transverse distance being such that said second and third bending moments are substantially equal to said first bending moment.

3. The assembly according to claim 1 or 2, wherein a support plate is disposed between said bearing and said terminal end of said other leg.

* * * * *